US006814001B2

(12) United States Patent
Westby et al.

(10) Patent No.: US 6,814,001 B2
(45) Date of Patent: Nov. 9, 2004

(54) INK PROOFER

(75) Inventors: Ronald K. Westby, Ramsey, MN (US); Daniel P. Westby, Ramsey, MN (US)

(73) Assignee: Integrity Engineering, Inc., Princeton, MN (US)

( * ) Notice: Subject to any disclaimer, the term of this patent is extended or adjusted under 35 U.S.C. 154(b) by 0 days.

(21) Appl. No.: 10/219,018

(22) Filed: Aug. 14, 2002

(65) Prior Publication Data

US 2003/0051618 A1 Mar. 20, 2003

Related U.S. Application Data

(60) Provisional application No. 60/312,595, filed on Aug. 15, 2001.

(51) Int. Cl.[7] ..... B41F 7/02; B41F 13/24; B41F 31/30

(52) U.S. Cl. ..... 101/218; 101/247; 101/329; 101/351.3

(58) Field of Search ..... 101/405, 406

(56) References Cited

U.S. PATENT DOCUMENTS

| | | | | |
|---|---|---|---|---|
| 1,442,287 A | | 1/1923 | Mattern | |
| 2,990,715 A | * | 7/1961 | Bradt | 73/150 R |
| 3,131,631 A | | 5/1964 | Haskin, Jr. | |
| 4,015,524 A | | 4/1977 | Herbert | |
| 4,522,057 A | * | 6/1985 | Kerchiss | 73/150 R |
| 4,852,486 A | | 8/1989 | Ely et al. | |
| 4,984,532 A | | 1/1991 | Winters | |
| 5,289,769 A | | 3/1994 | Lewis | |
| 5,485,782 A | | 1/1996 | Van Der Horst | |
| 5,495,800 A | | 3/1996 | Weissbein et al. | |
| 5,856,064 A | | 1/1999 | Chou | |
| 6,058,770 A | | 5/2000 | Engel | |
| 6,378,426 B1 | | 4/2002 | Furr, Jr. et al. | |
| 6,422,143 B1 | | 7/2002 | Lawrence et al. | |

FOREIGN PATENT DOCUMENTS

| | | |
|---|---|---|
| DE | 3938405 C1 | 11/1989 |
| EP | 0428767 A1 | 11/1989 |

OTHER PUBLICATIONS

American Ink Maker, "2001 Buyer's Guide Suppliers," Dec. 2000, pp. 109 and 159.
Little Joe Industries, "Little Joe," Aug. 14, 2001, 2 pages.
Little Joe Industries, "Little Joe Offset Proofing Press," 1 page.
Paramarco Global Graphics, "Precision Proofer," Aug. 7, 2001, 6 pages.

* cited by examiner

*Primary Examiner*—Andrew H. Hirshfeld
*Assistant Examiner*—Leo T. Hinze
(74) *Attorney, Agent, or Firm*—Patterson, Thuente, Skaar & Christensen, P.A.

(57) ABSTRACT

The present ink proofer arrangement generates consistent and reliable ink draw downs irrespective of the size of the substrate or the user preparing the ink sample. In one example embodiment, an ink proofer arrangement adapted to be used with an ink proofer tool, the ink proofer tool including an ink transfer roller. The ink proofer arrangement further includes a cylindrical roller and a drive motor adapted to rotate the roller. In addition, a first movable mounting assembly is included that retains the ink proofer tool adjacent to and in a non-contact position with the roller. The proofer arrangement further includes a first variable pressure assembly coupled to the mounting assembly and adapted to move the ink proofer tool into a contact with pressure position with the roller and further adapted to move the ink proofer tool into the non-contact position, wherein the transfer roller is adapted to transfer ink to a substrate that is inserted between the roller and the transfer roll of the ink proofer tool when the drive motor is engaged.

22 Claims, 13 Drawing Sheets

INK PROOFER

RELATED APPLICATIONS

The present application claims priority from U.S. Provisional Application having Ser. No. 60/312,595, filed Aug. 15, 2001, which is hereby incorporated by reference in its entirety.

TECHNICAL FIELD

The present invention relates generally to the field of flexographic printing and, more particularly, to a portable flexographic ink proofing apparatus for providing proofs of ink samples.

BACKGROUND OF THE INVENTION

In the field of flexographic printing ink samples are obtained by drawing ink over a substrate using a hand ink proofer of the type manufactured by Harper Companies International of Charlotte, N.C. The ink is applied to the substrate by manually rolling the hand proofer across the substrate. Manual ink proofer tools are utilized for proofing ink colors in order to accurately predict the results to be obtained by running a selected ink specimen in a printing press. A computer microscope is then used to view the ink smear on the substrate. The computer then indicates to the operator various color components to be added to the ink in order to achieve the desired ink coloration.

In a flexographic printing operation, rubber plates are utilized for delivering the ink to the stock or paper to be printed. A flexographic ink technician is usually given an ink specimen which has been determined to be acceptable for use on a particular press, and a production run sample, to be used as the standard for color and density. One of the most difficult tasks facing a flexographic ink technician is proofing an ink in a manner so that the color will duplicate the color of the production run sample from the flexographic printing press. It is well known among those skilled in the art that if three trained technicians pull an ink proof, using the same ink on the same hand proofer tool, three different color shades will result.

Color shade on a flexographic printing press is dependent on the ink film thickness applied to the substrate or stock. The ink film thickness is determined by the speed of the press, the pressure applied between the printing plate and paper (i.e., impression), and the pressure between the rollers on the printing unit. Similarly, color shade on a flexographic hand proofer tool is also dependent on the ink film thickness applied to the substrate which thickness is determined by the speed at which the technician pulls the hand proofer across the substrate, and the impression pressure the technician applies to the hand proofer while moving it across the substrate. Thus, the speed and impression is totally dependent on the manual skill of the flexographic ink technician, while the only variable not controlled by the technician is the pressure between the ink roller and transfer roller of the manual proofer tool.

Accordingly, there is a need for an ink proofer arrangement that provides a reliable, consistent and repeatable ink proof on a substrate, irrespective of the experience of the ink technician producing the ink proof. An approach that addresses the aforementioned problems, as well as other related problems, is therefore desirable.

SUMMARY OF THE INVENTION

The ink proofer of the present invention substantially meets the aforementioned needs of the industry. According to one aspect of the invention, the ink proofer arrangement provides for the constant speed roller which feeds paper through the device at a constant speed to generate a uniform ink smear. Further, the ink proofer arrangement provides for regulated pressure between the roller and an underlying drum on which the roller bears. Additionally, in one example embodiment, the ink proofer arrangement is explosion proof being an all pneumatic device.

According to another aspect of the present invention, the ink proofer arrangement includes a rotating drum that is disposed opposite and beneath a proofer roll of a hand ink proofer tool. The proofer roll of the proofer tool is elevated above the rotating drum and is lowered into compressive rotatable engagement with the rotating drum when the substrate (preferably paper) is introduced between the drum and the roller. The substrate advances between the roller and the drum at a selected speed. The pressure of the roller acting on the drum is selectable by an operator. Prior to the substrate paying out, a sensor senses the imminent end of the substrate and raises the roller to prevent contamination by being in contact with the drum when no substrate is present.

According to another aspect of the present invention, a digital speed control and an adjustable print pressure mechanism are provided such that the speed, impression and roller pressure are completely controlled by the ink proof technician, whereby the same ink color will be duplicated each time the apparatus is used.

The above summary of the present invention is not intended to describe each illustrated embodiment or every implementation of the present invention. The figures in the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
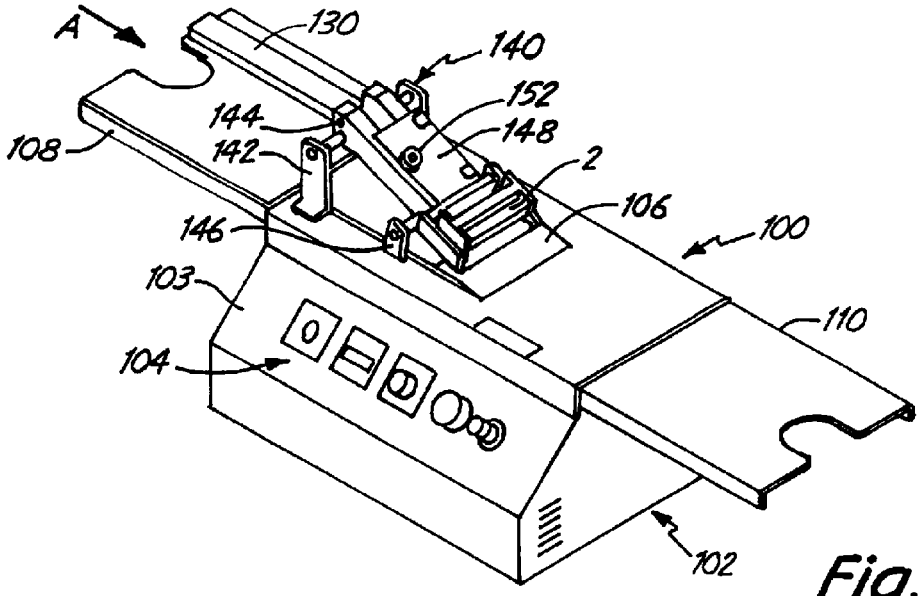
FIG. 1 is a perspective view of an embodiment of an ink proofer arrangement of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

The present invention is generally directed to an ink proofer arrangement that is adapted to operate with a variety of hand ink proofer devices to provide ink proofs that are reliable and repeatable and that are consistent from one ink proof to another. While the present invention is not necessarily limited to such an application, the invention will be better appreciated using a discussion of example embodiments in such a specific context.

In one example embodiment, an ink proofer arrangement adapted to be used with an ink proofer tool, the ink proofer tool including an ink transfer roller. The ink proofer arrangement further includes a cylindrical roller and a drive motor adapted to rotate the roller. In addition, a first movable mounting assembly is included that retains the ink proofer tool adjacent to and in a non-contact position with the roller. The proofer arrangement further includes a first variable pressure assembly coupled to the mounting assembly and adapted to move the ink proofer tool into a contact with pressure position with the roller and further adapted to move the ink proofer tool into the non-contact position, wherein the transfer roller is adapted to transfer ink to a substrate that is inserted between the roller and the transfer roll of the ink proofer tool when the drive motor is engaged.

In another related embodiment, an ink proofer arrangement is adapted to adapted to be used with an ink proofer tool, the ink proofer tool including an ink transfer roller, a cylindrical roller and a drive motor adapted to rotate the roller. In addition, a mounting assembly adapted to retain the ink proofer tool adjacent to and in a non-contact position with the roller. The ink proofer arrangement also includes a movable support assembly adapted to support the roller and a first variable pressure assembly coupled to the movable support assembly and adapted to move the roller into a contact with pressure position with the ink proofer and to move the roller into a non-contact position with the ink proofer tool, wherein the ink transfer roller is adapted to transfer ink to a substrate that is inserted between the roller and the transfer roll of the ink proofer tool when the drive motor is engaged.

Referring now to the Figures, FIG. 1 illustrates a perspective view of an embodiment of an ink proofer arrangement 100 of the present invention. In this example embodiment, ink proofer arrangement 100 includes a base unit 102 that supports a hand ink proofer tool 1 and is configured to move a substrate (not shown) through the unit via a base roller 106 to produce an ink proof. Base unit 102 includes a control panel 104 and a pair of support plates 110 and 108 (optional, depending on the length of the substrate) that can be simply clipped on when desired. In another embodiment, support plates 110 and 108 include a pair of guide rails for guiding a sheet of paper or other substrate through base unit 102. The combination of base unit 102 and ink proofer tool 1, according to the teachings of the present invention, facilitate generating ink proof samples irrespective of the manual ink drawing skills of the operator. Further, proofer arrangement 100 of the present invention is advantageously not necessarily limited to ink proofer tools of the type described hereinafter.

Proofer arrangement 100 further includes a housing 103, which in this example, embodiment is made to be spill proof such that the proofer arrangement can be washed down easily without damaging any of the internal components. Mounted on housing 103 are a number of control switches and displays that comprise control panel 104. Protruding from the upper surface of housing 103 is a rubber roller 106 that is driven by a drive motor (for moving a substrate in the direction of arrow A). Proofer arrangement 100 is also configurable to have roller 106 rotate in the opposite direction so that the arrangement is bi-directional with respect to movement of the substrate. Base unit 102 further includes support plates 108, 110 which can be mounted optionally on base unit 102 when the substrate is of considerable length.

Manual ink proofer tool 1 is supported on base unit 102 via an ink proofer tool support arrangement 140. In its simplest form proofer tool support arrangement 140 is simply an angled support structure that is affixed to the top of base unit 102 for supporting ink proofer tool 1 at a predetermined angle. In this particular embodiment, tool support arrangement 140 is designed to be movable in the vertical direction so as to raise and lower ink proofer tool 1 vertically up and away from roller 106 or vertically down and in contact with roller 106. Tool support arrangement 140 includes a vertical support bracket 142 that is coupled to a proofer tool support plate 144 that is in turn coupled to a proofer tool movement mechanism 146 which moves vertically up and down through the surface of the base unit 102 thereby moving ink proofer tool 1 as desired. Ink proofer tool 1 is secured to support arrangement 120 via a proofer tool secure plate 148 and a secure plate 152.

Figure 2A:
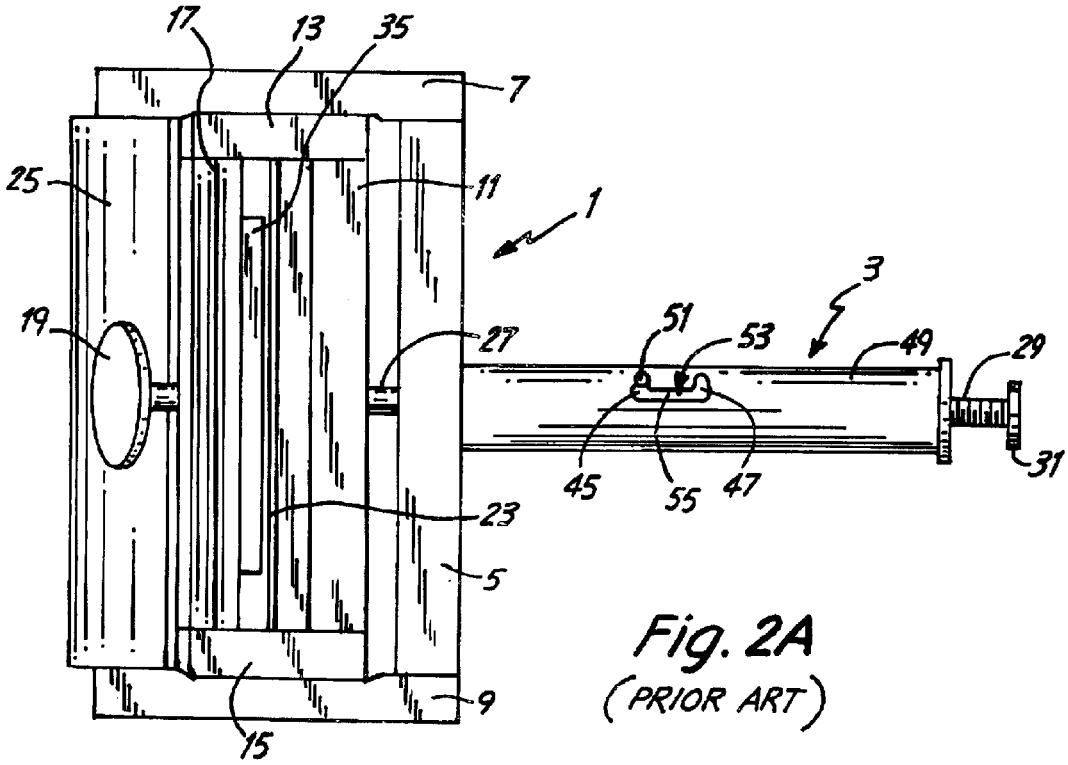
Fig. 2A (PRIOR ART)
FIG. 2A is a top view of an ink proofer tool that is mountable on one embodiment of the ink proofer arrangement of the present invention.
Figure 2B:
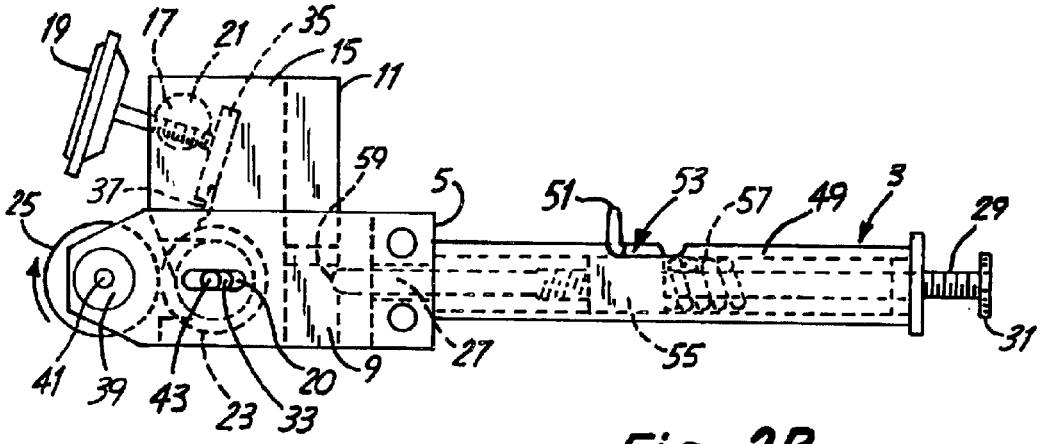
Fig. 2B (PRIOR ART)
FIG. 2B is a side view of an ink proofer tool of FIG. 2A.

FIGS. 2A and 2B illustrate top and side views, respectively, of ink proofer tool 1 that is mountable on one embodiment of the ink proofer arrangement 100. In particular, tool 1 includes a handle 3, a base frame 5 and sideframes 7 and 9. Base frame 5 has a hole that accommodates pressure rod 27 along with a threading for attaching handle 3 to the base frame. Sideframes 7 and 9 extend as shown and are adapted to receive a subframe and a transfer roll. Connected to sideframes 7 and 9 of base frame 5 is an anilox roll-nesting subframe 11. Subframe 11 has sides 13 and 15, as well as a blade adjustment means holder 17. Additionally, subframe sides 13 and 15 could be grooved and sideframes 7 and 9 could be likewise grooved in a complementary fashion so that they fit into one another. There is an indentation 59 which receives pressure rod 27 and this also helps maintain proper alignment of the subframe 11 within base frame sideframes 7 and 9.

Anilox roll 23 is located within nesting subframe 11 and its pins such as anilox roll pin 43 extends from anilox roll 23 to extend at least partially into or even through an elongated set of orifices, one on each of sideframes 7 and 9, illustrated by elongated orifice 20 shown in FIG. 2B. Anilox roll 23 is pressed against transfer roll 25 and pressure rod 27 maintains the pressure against nesting subframe 11 so that it forces anilox roll 23 against transfer roll 25 at a predetermined pressure resulting from rotation of pressure rod adjustment means 29, by rotating gripping dial 31, for example, clockwise to tighten and counterclockwise to un-tighten. Pressure rod adjustment means 29 is threaded and fits into pressure rod release means collar 55. Thus, the collar 55 is held in a position as shown so that as pressure rod adjustment means 29, when it is rotated downwardly or upwardly and is directly connected to pressure rod 27, ending in indentation 59 of subframe 11, causes the subframe 11 and anilox roll 23 to move accordingly.

Connected to subframe blade adjustment means holder 17 is blade adjustment means 19, in this case, a rotatable dial which includes a screw 21 which is threaded and passes through a screw tapped orifice in holder 17. At the end of screw 21 is blade holder 35 and blade 37 set up as a follower-type doctor blade so that ink may be located behind the doctor blade and the blade will both act as a wiping blade and as a distributing fountain. By rotation of blade adjustment means 19, for example clockwise to go upwardly away from subframe 11 and counterclockwise to go downwardly toward it, blade 37 may be adjusted against the surface of anilox roll 23 accordingly. In this device 1, the anilox roll 23 has bearings such as bearings 33 so as to facilitate its ease of rolling. Thus, the bearings are adapted to fit over the anilox roll pins such as pin 43 and are contained within a washer-type fitting which nests within the subframe 1. The sideframes 7 and 9 each also include a transfer roll pin holding insert such as insert 39. This is adapted to receive the transfer roll pins such as pin 41, as shown.

Referring again to handle 3 and hollow member 49, there is a pressure rod release means 53 which includes a cut-out as shown, pressure rod release means collar 55 and pressure rod release means lever 51, as well as spring 57. Spring 57 is strategically located and held in place so as to push collar 55 and therefore pressure rod adjustment means 29 and pressure rod 27 against the subframe 11. When pressure rod release means lever 51 is located in its first position, shown as first position 45, the pressure rod 27 is engaged with subframe 11 and, therefore under pressure. The pressure rod release means lever 51 may be pushed clockwise then away from the subframe 11 and then counterclockwise (in other words, in a "U" direction), so as to move from a first position 45 to second position 47. In second position 47, pressure rod 27 is totally disengaged from subframe 11 and subframe 11 may be easily removed or rotated for cleaning of the anilox roll 23 without affecting, altering or changing in any way the setting and therefore the pressure relationship which will be re-achieved when pressure rod release means lever 51 is moved from second position 47 back to first position 45.

Figure 5:
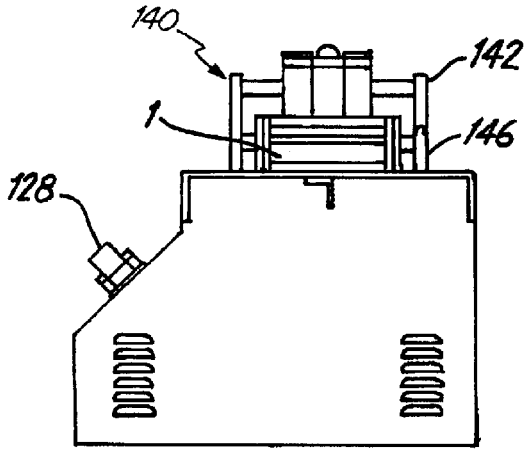
FIG. 5 is an end elevational view of the ink proofer with certain components depicted in phantom.
Figure 3:
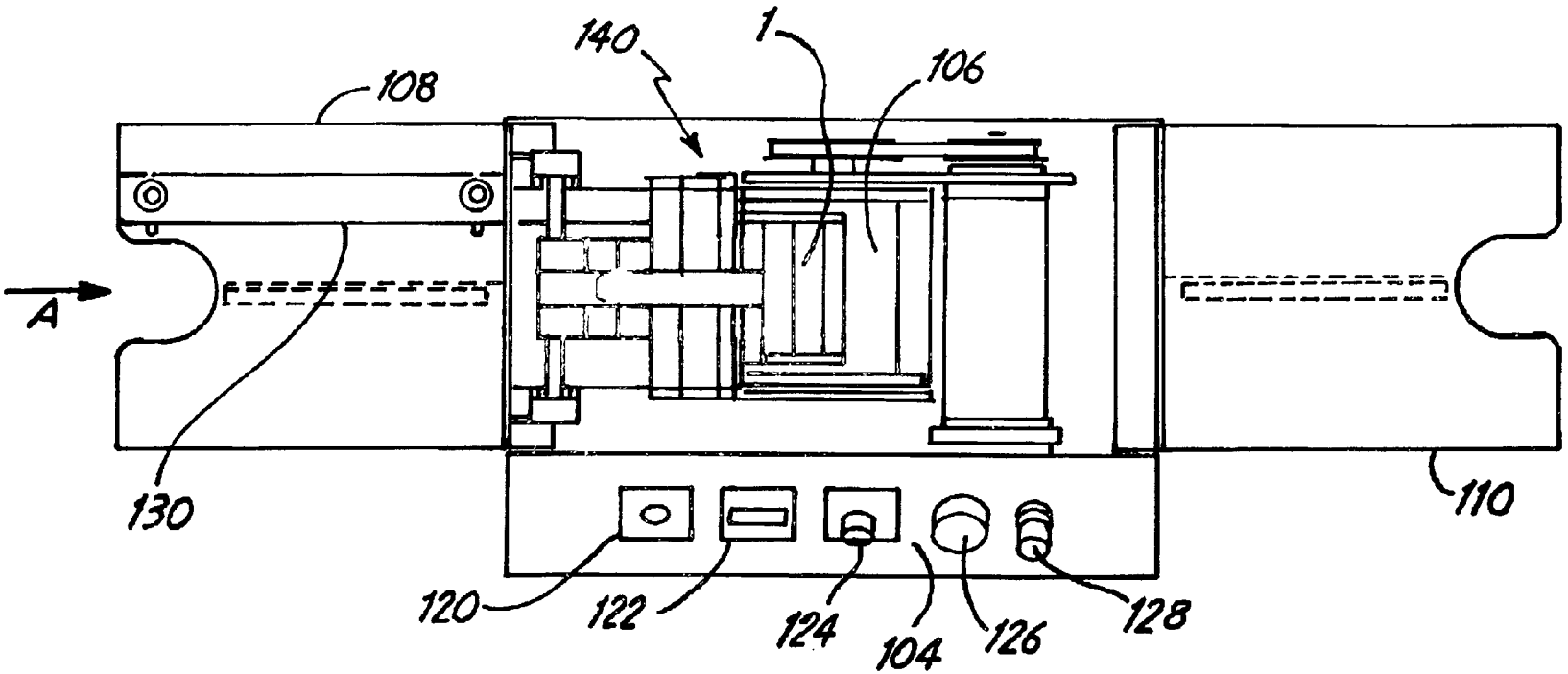
FIG. 3 is a top view of the ink proofer arrangement with certain components being depicted in phantom.
Figure 4:
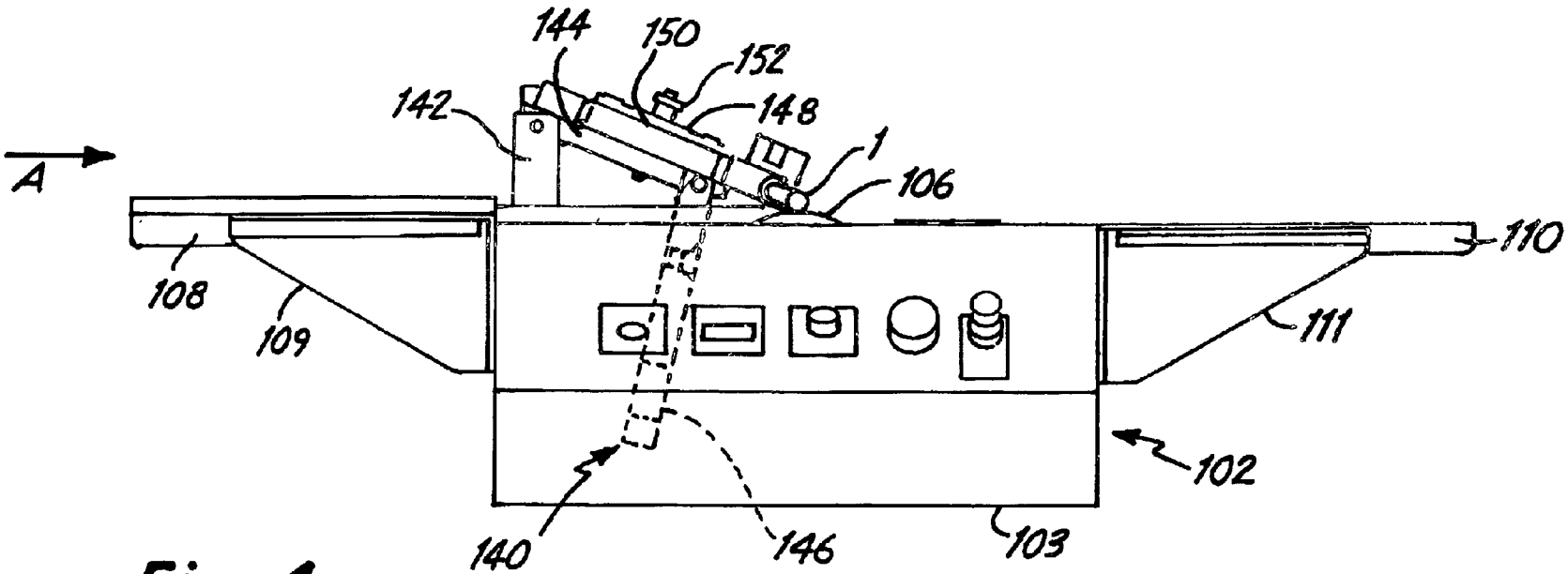
FIG. 4 is a side elevational view of the ink proofer with certain components being depicted in phantom.

Referring now to FIGS. 3–5, a preferred embodiment of proofer arrangement 100 of the present invention is shown. Base unit 102 includes a main housing 103 in which a rubber covered roller 106 is mounted that is driven by a drive motor (not shown) within base unit 102. In a preferred embodiment thereof, the drive roll comprises a cylindrical metallic roll having an elastomer covering on the cylindrical surface thereof.

As illustrated in FIG. 3 control panel 104 includes in this example embodiment an on/off switch 120 which can be substituted with a push button so as to control the proofer manually as the substrate is fed through the proofer arrangement 100. Control panel 104 also includes a digital speed display 122 as well as a speed control button 124 for setting the speed from anywhere to 200–900 FPM or 400–1500 FPM (feet per minute). The pressure gauge 126 is also included which provides feedback to the user when using the air regulator 128 to control the pressure of the roller 106 against the rollers of the ink proofer tool 1. Base unit 102 further includes substrate guide 130 for insuring that the substrate is fed evenly through proofer arrangement 100.

Referring to FIG. 4, in this example embodiment proofer arrangement 100 is configured to lift ink proofer tool 1 above roller 106 to provide the additional feature of keeping the roller 106 clean until the substrate is fed through arrangement 100 and proofer tool 1 is then placed on the substrate. In this example embodiment, proofer tool mechanism 146 senses as the substrate is about to terminate the so as to push up the proofer tool 1, thereby preventing ink from flowing onto roller 106. In a related embodiment, where a proofer tool movement mechanism 146 is not included, the operator can manually stop proofer arrangement 100 before the substrate comes to the end.

Referring briefly to FIG. 5, there is illustrated a side view of proofer arrangement 100 with the ink proofer tool 1 resting on the surface of roller 106. Ink proofer tool 1 is also resting on ink proofer tool support arrangement 140 located over base unit 102.

Figure 6A:
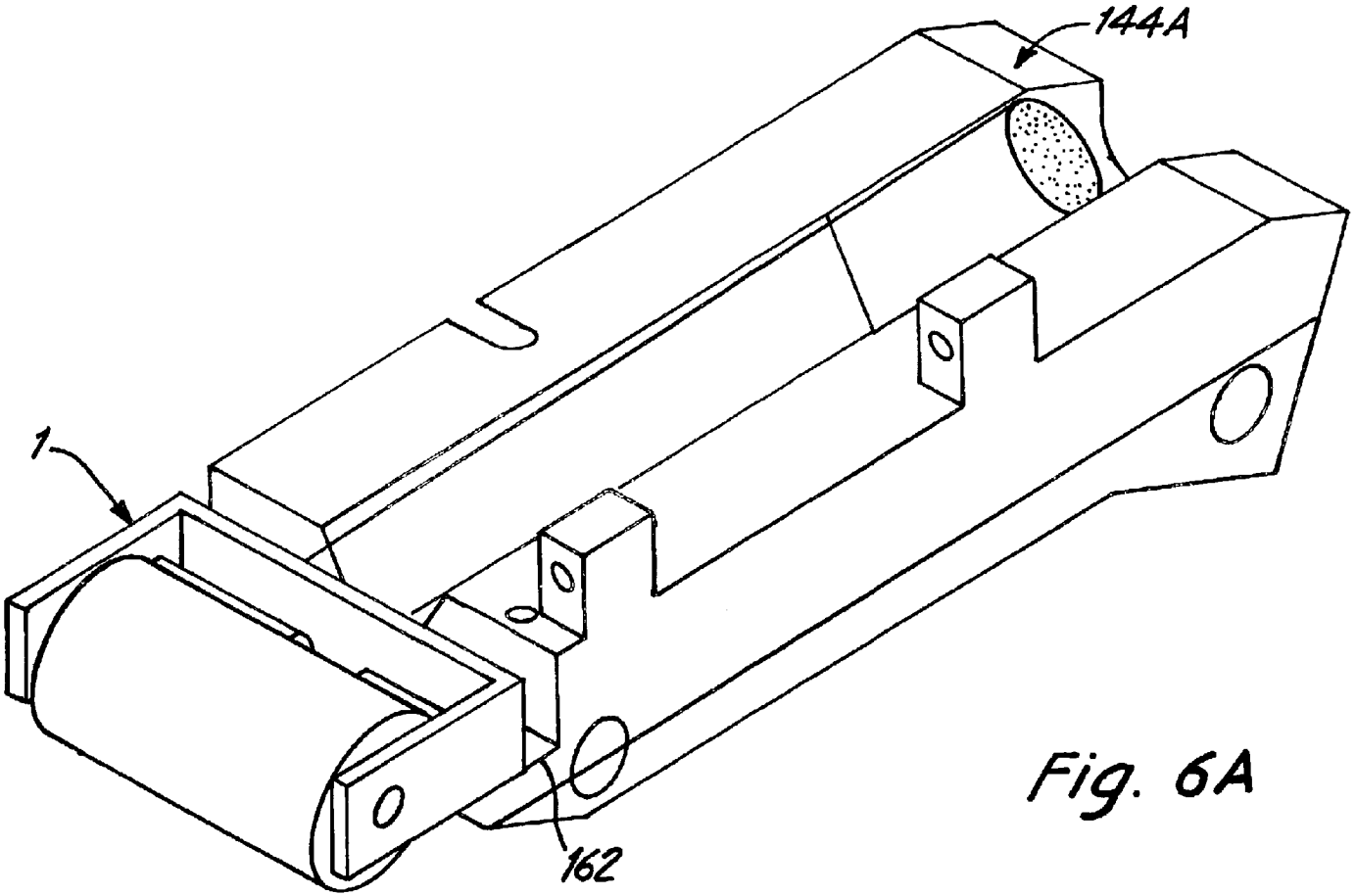
FIG. 6A is a universal ink proofer holder with an ink proofer mounted therein.

Referring now to FIG. 6A, there is illustrated ink proofer tool 1 that is set within a universal proofer holder 144*a* according to the present invention. The ink proofer is held within holder 144*a* via a notch 162.

Figure 6B:
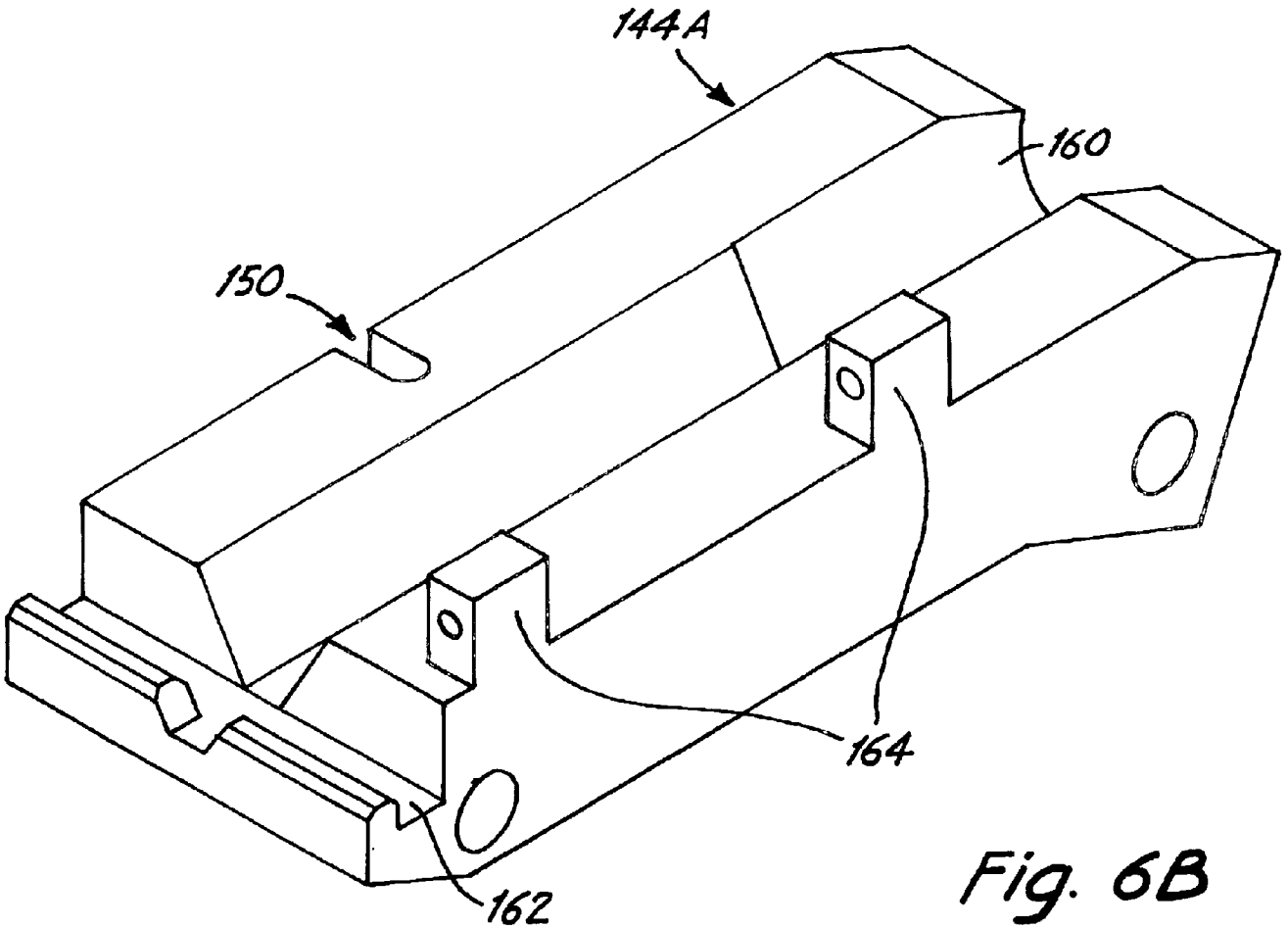
FIG. 6B is one embodiment of the universal proofer holder of FIG. 6A in accordance with the present invention.

FIG. 6B illustrates the universal proofer holder without ink proofer tool 1. Universal proofer holder 144*a* includes a channel 160, which accommodates the handle of the ink proofer, and a notch 162 that aids in maintaining the proofer in universal proofer holder 144*a*. Universal holder 144*a* further includes a set of hinges 164 that engage a cover plate that maintains the ink proofer tool in the universal holder. Holder 144*a* further includes an aperture 150 for accommodating a fastening screw 152 that maintains the cover plate over universal holder 144*a*.

Figure 6C:
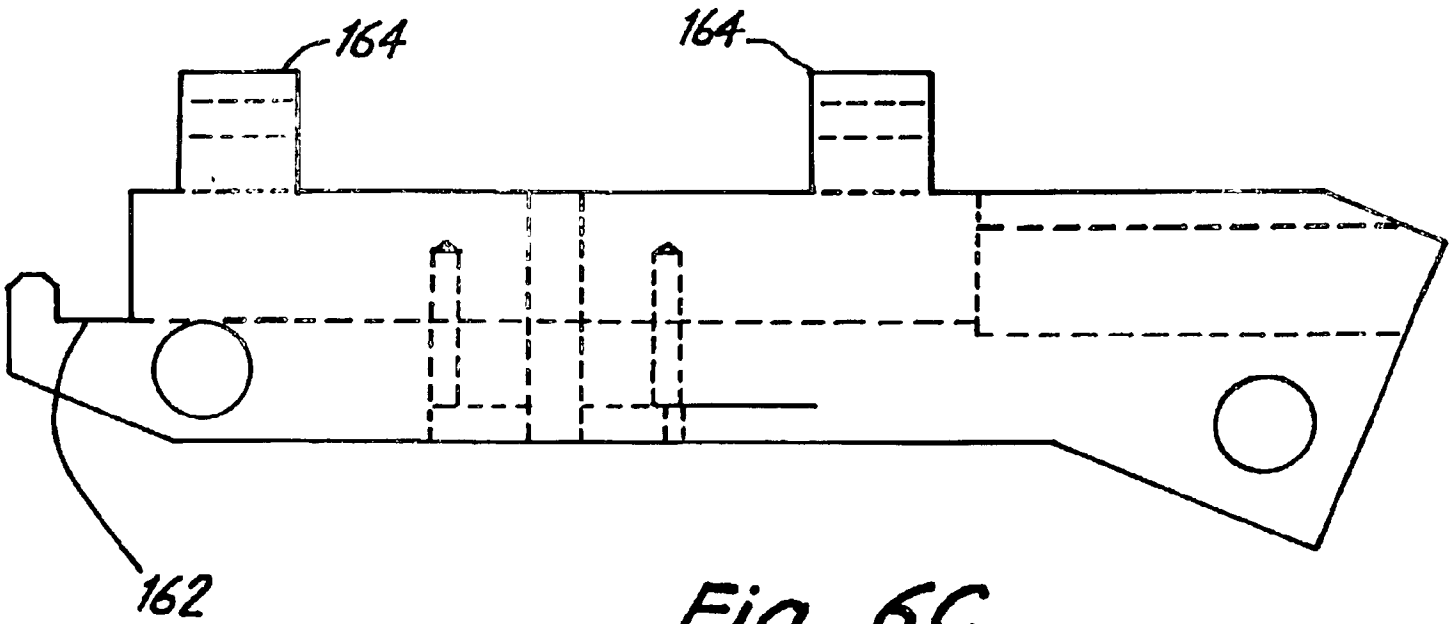
FIG. 6C is a side view of the universal proofer holder illustrated in FIG. 6B.

FIG. 6C illustrates a side view of universal holder 144*a* which includes notch 162 and hinges 164. In this embodiment, universal holder 144*a* is made from a polymer (i.e., plastic) but can also be made from metal or any other material that can be formed to include a channel 160 and notch 162. Channel 160, in this example embodiment, is formed in a V-shaped groove; however, it can be formed in a square groove or circular groove depending on the proofer handle configuration.

Figure 7:
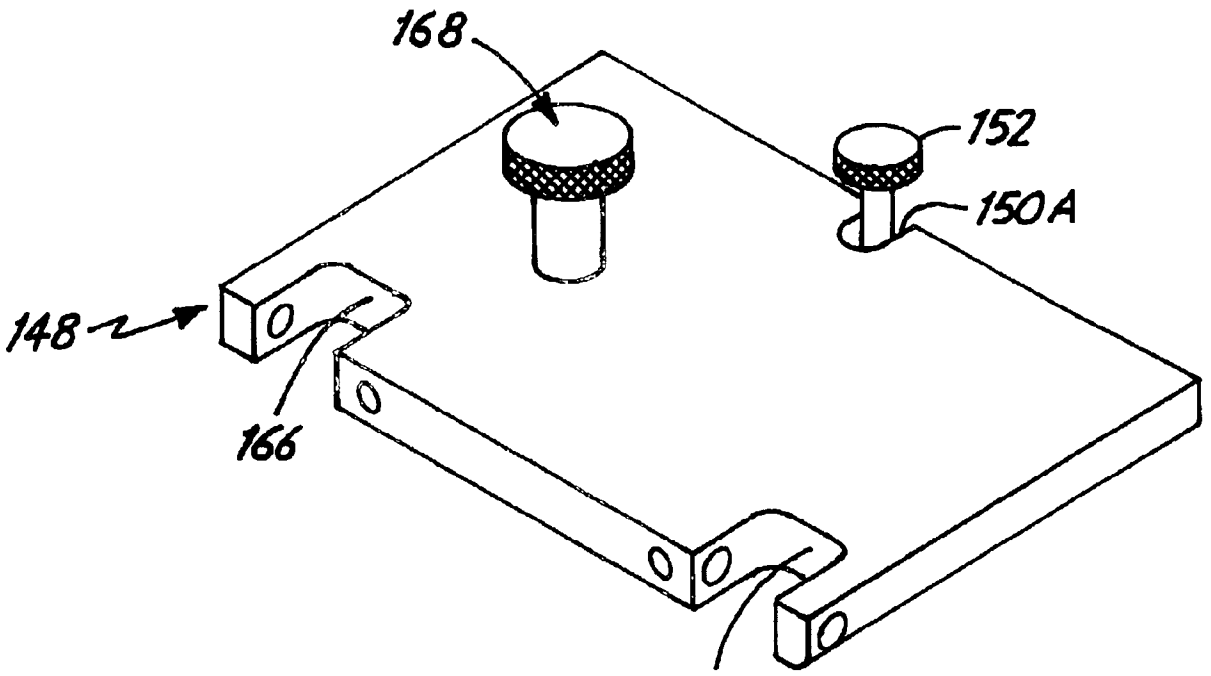
FIG. 7 is a perspective view of one embodiment of the cover plate for the universal proofer holder.

FIG. 7 illustrates one example embodiment of a cover plate 148 that includes hinge apertures 166 that engage hinges 164 of universal holder 144*a*. Cover plate 148 further includes an aperture 150*a* that corresponds with 150 on universal holder 144*a* for accommodating fastening screw 152. This example embodiment of cover plate 148 further includes an adjustment knob 168 for adding downward pressure to an ink proofer handle located in channel 160 to secure the proofer holder in the channel. Adjustment knob 168 provides the advantage of allowing universal holder 144*a* to accommodate the proofer handles of various diameters while still allowing some angular movement in the proofer handle during the ink draw down process.

Figure 8A:
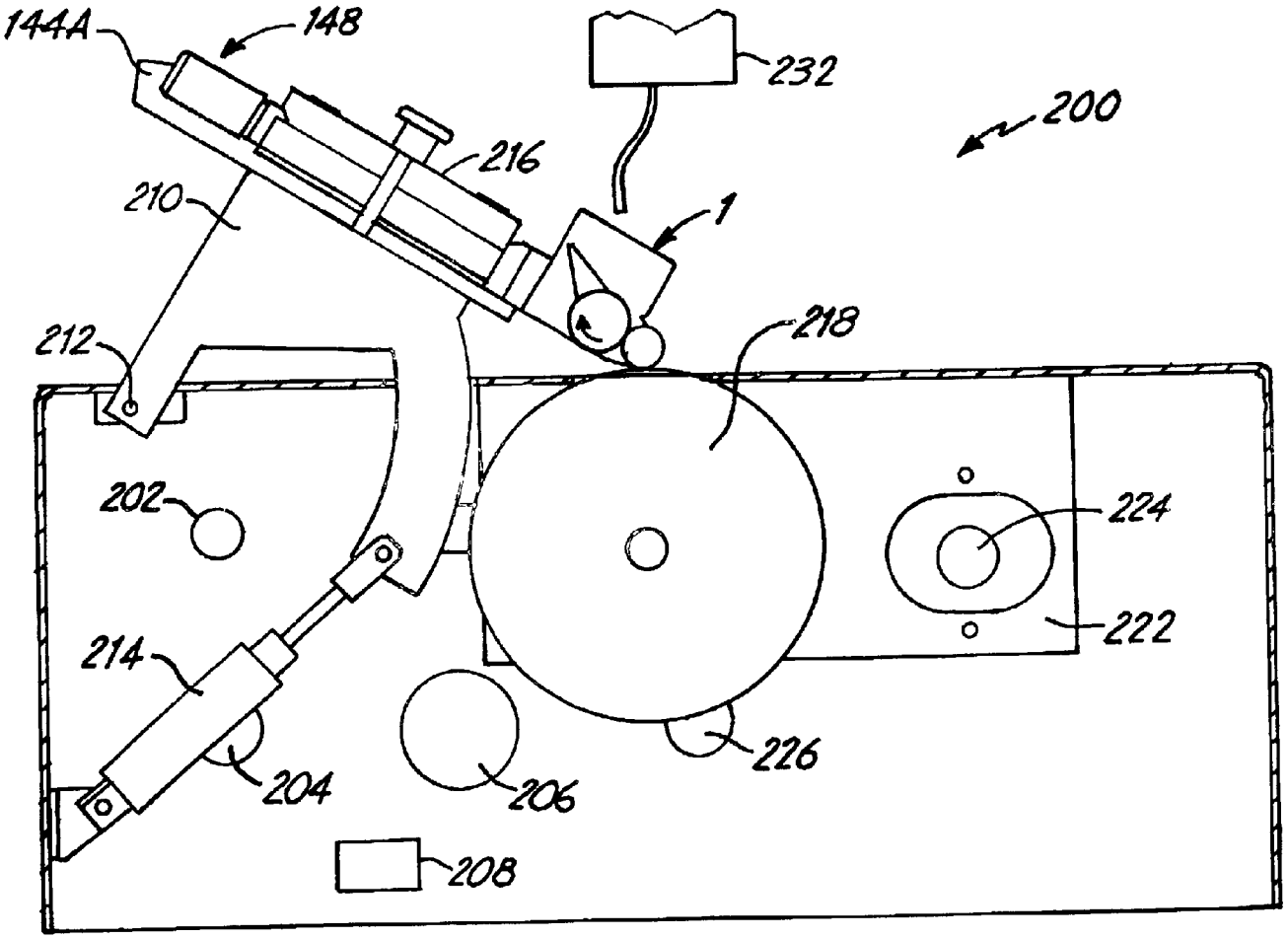
FIG. 8A is a side view of another embodiment of an ink proofer arrangement of the present invention.
Figure 8B:
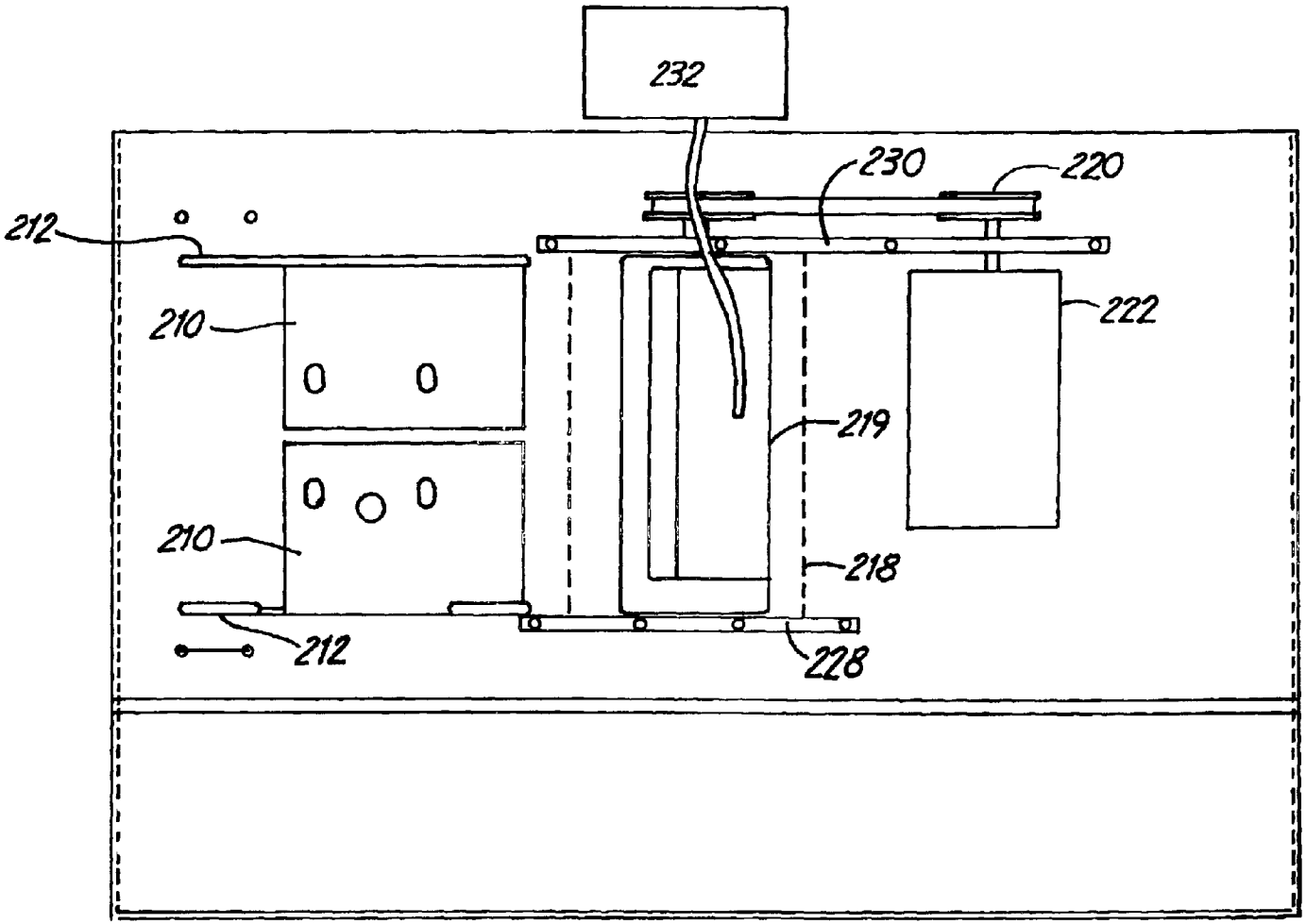
FIG. 8B is the top view of the ink proofer arrangement illustrated in FIG. 8A.
Figure 8C:
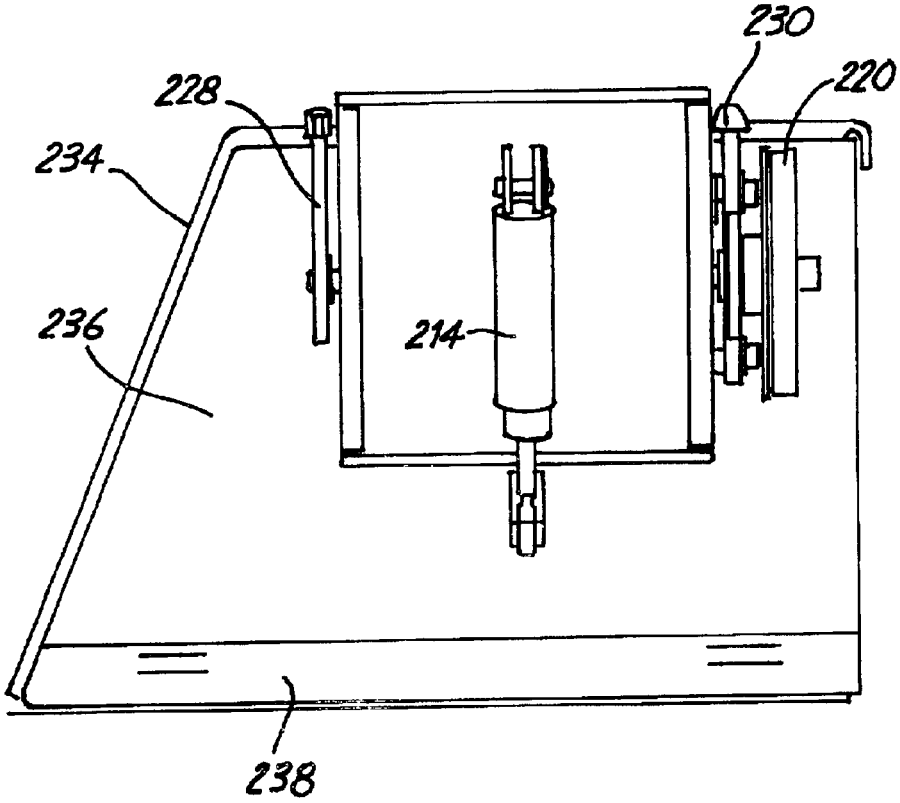
FIG. 8C is a side view of the ink proofer arrangement illustrated in FIG. 8A.

Referring now to FIGS. 8A–8C, there is illustrated another example embodiment of proofer arrangement 200 that is configured to automatically lift ink proofer tool 1 (default position) above a roller 218 when a start button 266 is disengaged. Proofer arrangement 200 includes a pressure gauge 202 and a pressure adjust 204 which allows the user to adjust the pressure of the hand proofer tool on the substrate used to create the ink proof. Proofer arrangement 200 further includes a speed adjust 206 and a digital speed read-out tool 208 that allows the user to adjust the speed of the roller that moves the substrate under the ink proofer tool 1. A unibody frame 210 that accommodates universal holder 144*a* and ink proofer tool 1 is attached to a pivot point 212 of arrangement 200. The other end of unibody frame 210 is attached to an actuation/pressure cylinder 214 which operates to move unibody frame vertically, thereby moving the proofer handle up when the proofer arrangement 200 is actuated by start button 226. Proofer arrangement 200 further includes a proofer tool support assembly that is comprised of the universal holder 144*a*, a cover plate 148 and hand proofer tool 1. Coated roller 218 is driven by a belt and pulley drive 220 (via a cog belt) that is further driven by an air motor 222 located adjacent the coated roller. The speed of motor 222 is controlled by air motor speed control 224 via the exhaust of motor 222.

FIG. 8B illustrates a top view of proofer arrangement 200 that includes the unibody 210 that pivots around pivot points 212. Roller 218 is partially shown in visible lines as part of it protrudes through a roller window 219 which protrudes through the top plate of proofer arrangement 200. Roller 218 is supported by roller support bracket 228 and roller and motor support bracket 230. Motor 222 drives pulley drive 220 which in turn drives roller 218 thereby moving the substrate across the surface of proofer arrangement 200. In this example embodiment, an ink well 232 with a tube can be adapted to provide a continuous supply of ink to the proofer tool disposed above the substrate and roller 218.

FIG. 8C illustrates a side view of proofer arrangement 200 including pulley drive 220 and brackets 228 and 230. In addition, the housing of proofer arrangement 200 includes a spill proof top 234 with spill proof sides and back 236 as well as an open vent bottom 238. With open vent bottom 238 proofer arrangements 100 and 200 can be easily washed down and cleaned because the unit can drain the fluids through the bottom vents and can air dry quickly to facilitate its use in industrial environments.

Figure 9:
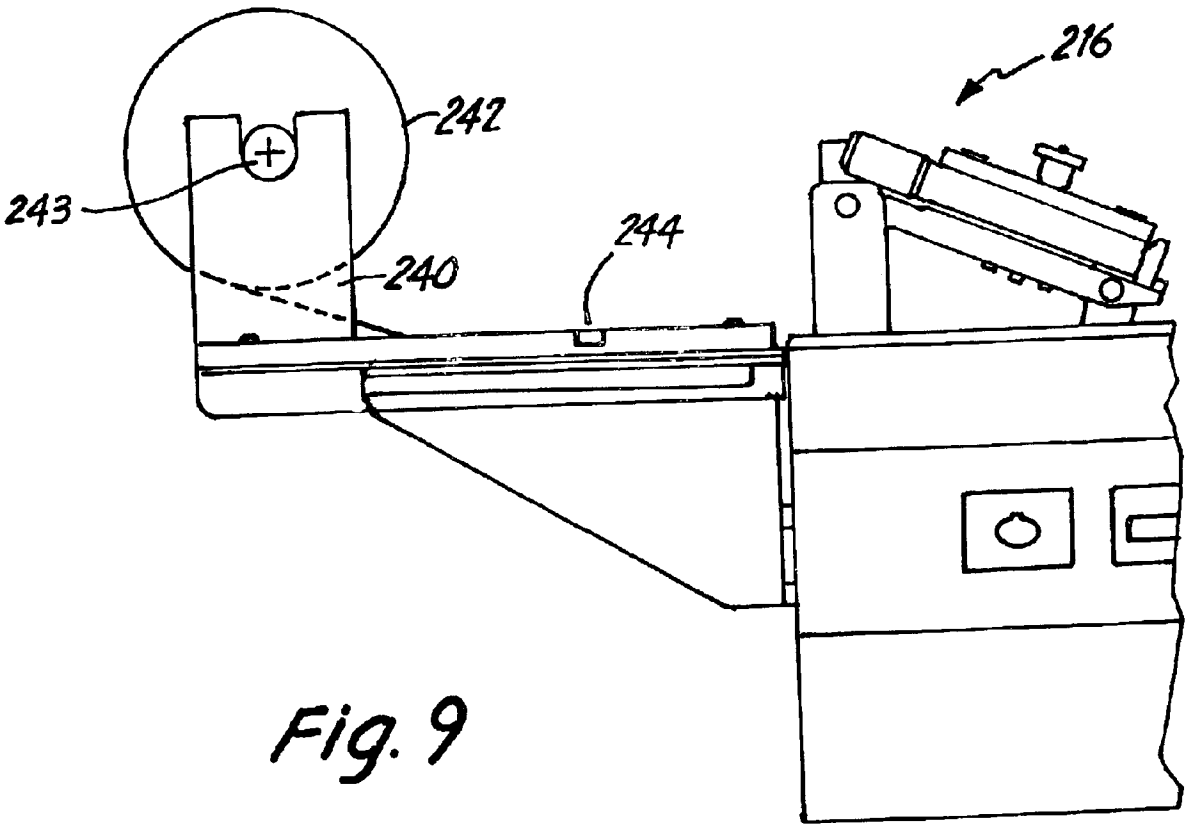
FIG. 9 is a substrate roll attachment for the ink proofer arrangement of the present invention.

FIG. 9 illustrates a substrate roll support 240 that can be retroactively attached to any of the proofer arrangements disclosed herein. Substrate roll support 240 includes at least one bracket for mounting substrate roll 242 through a rod 243 that helps to roll the substrate past a cutting groove 244 and under proofer tool support assembly 216. This embodiment provides the user with ink proof samples of various sizes depending on the desired application. The substrate can also be configured with or to include perforations in order to simplify the formation of ink proofs without having to provide a paper or substrate cutter to the proofer arrangement.

Figure 10:
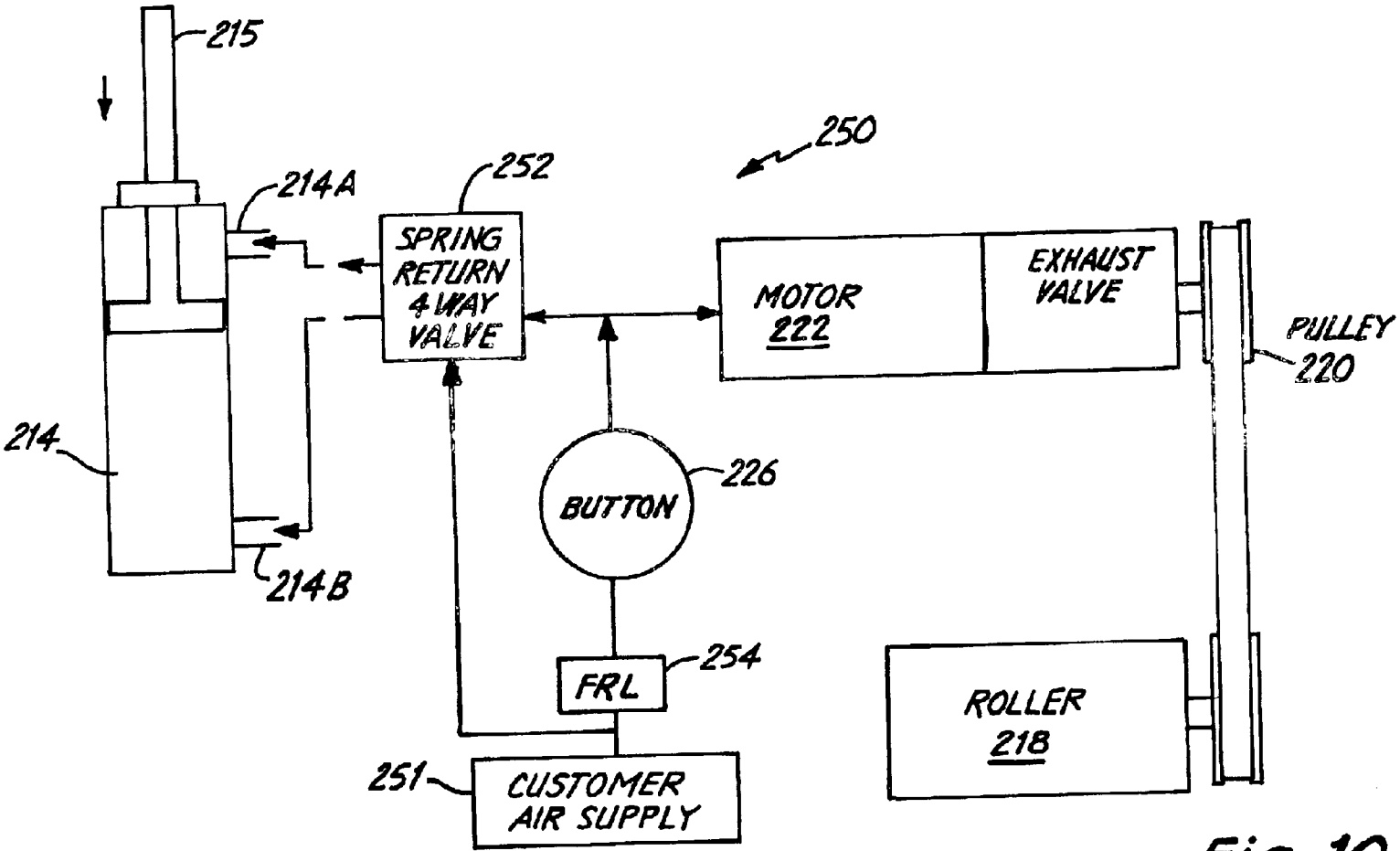
FIG. 10 is a schematic drawing of actuation of the pressure cylinder controlling the universal proofer holder of the present invention.

FIG. 10 illustrates a schematic of a hand proofer pressure actuation system 250 according to the teachings of the present invention. In particular, system 250 assists in moving proofer tool support assembly 216 vertically with respect to roller 218. System 250 receives air from the customer's plant via air supply 251 which is thereafter provided to a spring return four-way valve 252 and to a regulator lubricator device 254 before it is connected to start button 226. When start button 226 is actuated air is provided to both motor 222 and to valve 252. Motor 222 in turn drives pulley drive 220 which drives roller 218. The air supplied by pressing button 226 in turn actuates valve 252 such that air is supplied to either upper port 214*a* of pressure cylinder 214 or lower port 214*b* which raises or lowers the plunger within cylinder 214. Moving plunger within pressure cylinder 214 in turn moves unit body 210 vertically with respect to roller 218. When button 226 is released, cylinder 214 returns to its default position, which is in the up position away from roller 218. System 250 is configured such that when button 226 is actuated roller 218 begins to rotate as unibody 210 drops down to engage the substrate and roller 218. Once the button 226 is released roller 218 stops rolling because the air supply to motor 222 has been cut off and plunger 215 of cylinder 214 returns to its extended position thereby raising the unibody frame 210.

In an alternative embodiment, system 250 can be configured to add a pressure cylinder to roller arrangement such that the roller is moved vertically into window 219 when button 226 is depressed and moves away from window 219 when button 226 is released. In yet another embodiment, system 250 is configurable to include two pressure cylinders such that both unibody 210 with ink proofer 1 moves in a downward direction towards roller 218 while roller 218 moves in an upward direction so as to engage the substrate at the surface of the proofer arrangement. With the appropriate controls the pressure of ink proofer 1 can be adjusted online depending on the types of proofs that are desired. For instance, as the proof is being developed different pressures can be applied along the length of the ink proof to determine which is the best pressure for placing the ink on the substrate. One of the advantages of the present invention is that pressure of the ink proofer can be varied from ink proofer arrangement 200 and need not be controlled from ink proofer tool 1. In addition, the speed can also be controlled from proofer arrangement 200 as pressure is simultaneously varied without interfering with ink proofer tool 1. In another embodiment, proofer arrangements 100 and 200 can be retrofitted with end of substrate sensors to disengage the hand proofer tool and prevent ink from flowing over roller 218 and onto the top of the proofer arrangement. In one example embodiment, an air logic sensor can be retrofitted on the rear flange of proofer arrangement 100 which then signals spring valve 252 to raise pressure cylinder 214 and lift the proofer away from the roller. In another related embodiment a photo light sensor can also be used to detect the end of the substrate thereby actuating valve 252 while button 226 remains depressed.

Proofer arrangement 100 is also configured to be self-equalizing thereby providing a wrist action to allow the rolls on the ink proofer tool 1 and roller 106 to conform to any movement of wobble during the ink proofing process. By using a pneumatic drive mechanism the concerns that ink technicians which utilize solvents with low flash points may be alleviated when using the present invention. In a related embodiment the drum or roller 106 has a speed sensing device that will read out in feet per minute which will provide an at actual speed read out with control and various speed controls. Proofer arrangement 100 also includes a down pressure gauge to determine how many pounds of pressure is being applied with the ink proofer tool 1.

In this example embodiment, the drive motor is preferably of the air type (½ horse power) but proofer arrangement 100 can also be configured to operate with a clutch drive and clutch brake assembly. In other embodiments, the drive motor can include a DC motor, an electric motor or an AC motor. In this example embodiment, roller 20 is comprised of a natural rubber coating of 70–75 Durometer hardness bonded onto an aluminum roll. Proofer arrangement 100 enables the user of the present invention to achieve or reproduce the same angles of printing encountered during commercial flexographic printing while faster proofing speeds are provided by the air motor driven motor.

One example embodiment of the ink proofer arrangement can proof a maximum width of six inches. Further, the proofer will process almost any length of substrate desired. A minimum of 9½ inches of substrate is required. Additional widths may be specified in increments of 2 inches up to a width of 14 inches.

The ink proofer arrangement may also be adjusted for proofing speeds of 50 to 1,500 feet per minute with other ranges being available as desired. The ink proofer includes precision readouts for speed of the substrate and down pressure on the proofer arrangement.

In one example embodiment, ink proofer arrangement 100 is fully automatic, but manual operations are also contemplated. The substrate is introduced in the left side of the ink proofer arrangement (denoted by arrow A) and by pressing the actuation button, proofer arrangement 100 automatically feeds the substrate through the proofer arrangement and the substrate is discharged on the right side.

The various embodiments of the present invention provide ink proofer arrangements, primarily directed to the flexographic field, that are portable and provide the advantages of constant speed and constant pressure to enable repeatability of ink proofs irrespective of the experience of the ink proofer arrangement user.

The present invention may be embodied in other specific forms without departing from the essential attributes thereof; therefore, the illustrated embodiments should be considered in all respects as illustrative and not restrictive, reference being made to the appended claims rather than to the foregoing description to indicate the scope of the invention.

What is claimed is:

1. An ink proofer arrangement adapted to be used with a hand-held ink proofer tool, the hand-held ink proofer tool including an ink transfer roller, comprising:

a cylindrical drum;

a drive motor adapted to rotate the drum;

a first movable mounting assembly comprising a universal ink proofer holder having a channel for retaining the hand-held ink proofer tool and adapted to retain the ink proofer tool adjacent to and in a non-contact position with the drum; and a first variable pressure assembly coupled to the mounting assembly and adapted to move the ink proofer tool into a contact with pressure position with the drum and further adapted to move the ink proofer tool into the non-contact position, wherein the transfer roller is adapted to transfer ink to a substrate that is inserted between the drum and the transfer roller of the ink proofer tool when the drive motor is engaged.

2. An ink proofer arrangement as in claim 1, further comprising:

a second movable mounting assembly adapted to support the drum; and a second variable pressure assembly coupled to the second mounting assembly and adapted to move the drum into a contact position with the ink proofer tool and to move the drum to a non-contact position with the ink proofer tool.

3. The ink proofer arrangement of claim 1, wherein the first variable pressure assembly is adapted to move the ink proofer tool into the contact with pressure position with the drum when the drive motor is engaged and to move the ink proofer tool into the non-contact position when the drive motor is disengaged.

4. The ink proofer arrangement of claim 2, wherein the second variable pressure assembly is adapted to move the drum into a contact position with the ink proofer tool when the drive motor is engaged and to move the roller to a non-contact position with the ink proofer tool when the drive motor is disengaged.

5. An ink proofer arrangement of claim 1, wherein the drive motor is further adapted to rotate the drum at variable speeds.

6. The ink proofer arrangement of claim 5, wherein speed reduction for the drive motor is selected from the group consisting of a belt and pulley arrangement, direct or indirect gear reduction and a variable speed mechanical drive.

7. The ink proofer arrangement of claim 1, wherein the first mounting assembly actuates the drive motor when pressure is applied to the first mounting assembly.

8. The ink proofer arrangement of claim 1, wherein the universal ink proofer holder comprises a notch therein for retaining the ink proofer tool.

9. The ink proofer arrangement of claim 1, further comprising a substrate roll support assembly mounted adjacent the mounting assembly.

10. An ink proofer arrangement adapted to be used with a hand-held ink proofer tool, the ink proofer tool including an ink transfer roller, comprising:

a cylindrical drum;

a drive motor adapted to rotate the drum;

a mounting assembly comprising a universal ink proofer holder having a channel and a notch for retaining the hand-held ink proofer tool and adapted to retain the ink proofer tool adjacent to and in a non-contact position with the cylindrical roller;

a movable support assembly adapted to support the drum; and a first variable pressure assembly coupled to the movable support assembly and adapted to move the drum into a contact with pressure position with the ink proofer and to move the drum into a non-contact position with the ink proofer tool, wherein the ink transfer roller is adapted to transfer ink to a substrate that is inserted between the drum and the transfer roll of the ink proofer tool when the drive motor is engaged.

11. An ink proofer arrangement adapted to be used with a hand-held ink proofer tool, the ink proofer tool including an ink transfer roller, comprising:

a cylindrical drum;

a drive motor adapted to rotate the drum;

a mounting assembly comprising a universal ink proofer holder having a channel for retaining the hand-held ink proofer tool and adapted to retain the ink proofer tool adjacent to and in a non-contact position with the cylindrical drum;

a movable support assembly adapted to support the drum; and a first variable pressure assembly coupled to the movable support assembly and adapted to move the drum into a contact with pressure position with the ink proofer and to move the drum into a non-contact position with the ink proofer tool, wherein the ink transfer roller is adapted to transfer ink to a substrate that is inserted between the drum and the transfer roll of the ink proofer tool when the drive motor is engaged.

12. An ink proofer arrangement of claim 11, wherein the mounting assembly is configured to be movable, the arrangement further comprising a second variable pressure assembly coupled to the mounting assembly and adapted to move the ink proofer tool into a contact position with the drum when the drive motor is engaged and to move the ink proofer tool into the non-contact position with the drum when the drive motor is disengaged.

13. The ink proofer arrangement of claim 12, wherein the second variable pressure assembly is adapted to move the ink proofer tool into the contact position with the drum when the drive motor is engaged and to move the ink proofer tool into the non-contact position with the drum when the drive motor is disengaged.

14. The ink proofer arrangement of claim 11, wherein the first variable pressure assembly coupled to the movable support assembly and adapted to move the drum into the contact position with the ink proofer when the drive motor is engaged and to move the drum into a non-contact position with the ink proofer tool when the drive motor is disengaged.

15. The ink proofer arrangement of claim 11, wherein the drive motor is further adapted to rotate the drum at variable speeds.

16. The ink proofer arrangement of claim 15, wherein speed reduction for the drive motor is selected from the group consisting of a belt and pulley arrangement, direct or indirect gear reduction and a variable speed mechanical drive.

17. The ink proofer arrangement of claim 11, wherein the first mounting assembly actuates the drive motor when pressure is applied to the first mounting assembly.

18. The ink proofer arrangement of claim 11, wherein the universal ink proofer holder comprises a notch therein for retaining the ink proofer tool.

19. The ink proofer arrangement of claim 11, further comprising a substrate roll support assembly mounted adjacent the mounting assembly.

20. An ink proofer arrangement adapted to be used with a hand-held ink proofer tool, the ink proofer tool including an ink transfer roller, comprising:

a cylindrical drum;

a drive motor adapted to rotate the drum;

a mounting assembly comprising a universal ink proofer holder adapted to retain the hand-held ink proofer tool and adapted to retain the ink proofer tool adjacent to and in a non-contact position with the cylindrical roller;

a movable support assembly adapted to support the drum; and a first variable pressure assembly coupled to the movable support assembly and adapted to move the drum into a contact with pressure position with the ink proofer and to move the drum into a non-contact position with the ink proofer tool, wherein the ink transfer roller is adapted to transfer ink to a substrate that is inserted between the drum and the transfer roll of the ink proofer tool when the drive motor is engaged.

21. An ink proofer arrangement adapted to be used with a hand-held ink proofer tool, the ink proofer tool including an ink transfer roller, comprising:

a cylindrical drum;

a drive motor adapted to rotate the drum;

a first movable mounting assembly comprising a universal ink proofer holder adapted to retain the hand-held ink proofer tool and adapted to retain the ink proofer tool adjacent to and in a non-contact position with the drum; and a first variable pressure assembly coupled to the mounting assembly and adapted to move the ink proofer tool into a contact with pressure position with the drum and further adapted to move the ink proofer tool into the non-contact position, wherein the transfer roller is adapted to transfer ink to a substrate that is inserted between the drum and the transfer roller of the ink proofer tool when the drive motor is engaged.

22. An ink proofer arrangement adapted to be used with a hand-held ink proofer tool, the ink proofer tool including an ink transfer roller, comprising:

a cylindrical drum;

a drive motor adapted to rotate the drum;

a first movable mounting assembly comprising a universal ink proofer holder having a channel and a notch for retaining the hand-held ink proofer tool and adapted to retain the ink proofer tool adjacent to and in a non-contact position with the drum; and a first variable pressure assembly coupled to the mounting assembly and adapted to move the ink proofer tool into a contact with pressure position with the drum and further adapted to move the ink proofer tool into the non-contact position, wherein the transfer roller is adapted to transfer ink to a substrate that is inserted between the drum and the transfer roller of the ink proofer tool when the drive motor is engaged.

* * * * *